US006330888B1

(12) United States Patent
Aravantinos et al.

(10) Patent No.: US 6,330,888 B1
(45) Date of Patent: Dec. 18, 2001

(54) VISUAL STIMULATION CANE FOR PARKINSON'S DISEASE SUFFERERS

(76) Inventors: Dimitrios Aravantinos; Katina Aravantinos, both of 119 Longdale Dr., Liverpool, NY (US) 13090; Harold R. Murphy, 209 N. Bellinger St., Herkimer, NY (US) 13350

( * ) Notice: Subject to any disclaimer, the term of this patent is extended or adjusted under 35 U.S.C. 154(b) by 0 days.

(21) Appl. No.: 09/557,310

(22) Filed: Apr. 25, 2000

(51) Int. Cl.[7] ..... A45B 3/60

(52) U.S. Cl. ..... 135/66; 135/70; 135/84; 135/910; 135/80; 362/102

(58) Field of Search ..... 135/65, 66, 68, 135/75, 77, 80, 84, 82, 910, 911, 70; 362/102

(56) References Cited

U.S. PATENT DOCUMENTS

| | | | | |
|---|---|---|---|---|
| D. 391,073 | * | 2/1998 | Starks | D3/7 |
| 1,621,255 | * | 3/1927 | Hunter | 135/77 X |
| 3,251,371 | | 5/1966 | Croker | 315/47 |
| 3,272,210 | * | 9/1966 | Boruvka | 135/84 |
| 3,763,872 | | 10/1973 | Gooley | 135/47 |
| 3,987,807 | | 10/1976 | Varnell | 135/66 |
| 4,062,372 | | 12/1977 | Slusher | 135/66 |
| 4,299,246 | * | 11/1981 | Marsh | 135/66 |
| 4,811,750 | | 3/1989 | McAllister | 135/66 |
| 4,884,587 | * | 12/1989 | Mungons | 135/65 |
| 5,176,160 | | 1/1993 | Osborn | 135/66 |
| 5,433,234 | | 7/1995 | Lapere | 135/66 |
| 5,575,294 | * | 11/1996 | Perry et al. | 362/102 X |
| 5,636,650 | | 6/1997 | Kroeze | 135/66 |
| 5,640,985 | | 6/1997 | Snyder et al. | 135/65 |
| 5,755,245 | | 5/1998 | Van Helvoort | 135/70 |
| 5,806,548 | * | 9/1998 | Goldstein et al. | 135/77 X |
| 5,845,664 | | 12/1998 | Ryder et al. | 135/65 |
| 5,975,100 | | 11/1999 | Sfeir | 135/66 |
| 6,027,434 | | 2/2000 | Gibbons | 482/131 |
| 6,055,997 | | 5/2000 | Greenstadt et al. | 135/65 |

OTHER PUBLICATIONS

Walde–Douglas, et al., Parkinson's Disease: Fitness Counts, Chap. 5, Improving Gait and Balance, National Parkinson Foundation, Inc., 1999.

* cited by examiner

*Primary Examiner*—Winnie S. Yip
(74) *Attorney, Agent, or Firm*—Bernhard P. Molldrem, Jr.

(57) ABSTRACT

A visual stimulation cane or walking stick assists a Parkinson's Disease patient in overcoming a sudden immobility or freezing episode. The cane carries a visual indicator, which can be a plastic strip or leg, and which can be extended when needed to provide visual stimulation to initiate stepping. An actuator mechanism can include a plunger at the base of the cane, and a pivot member on which the indicator leg is carried. A lock/unlock knob allows the cane either to be used as a normal walking cane without visual stimulation, or to be used to overcome a freezing episode.

20 Claims, 3 Drawing Sheets

VISUAL STIMULATION CANE FOR PARKINSON'S DISEASE SUFFERERS

BACKGROUND OF THE INVENTION

The present invention relates to walking assistance devices, such as canes, crutches, and walking sticks, and is more particularly directed to such a device that includes a visual stimulation mechanism to assist a Parkinson's Disease victim in overcoming a sudden loss of mobility or motor block episode, i.e., "freezing."

Parkinson's Disease is a neurological disorder caused by imbalance of chemical messengers in the central nervous system. This disease can result in loss of control over voluntary movement in the patient. Some of the well known symptoms are resting tremor, i.e., shaking; slowness of movement or bradykinesia; muscular rigidity or stiffness; and impairment of postural righting reflexes, i.e., balance. Other symptoms may include changes in gait while walking, including shuffling of feet, short steps, difficulty with turns, and decreased arm swing on the affected side. The usual medical management strategy involves medication, and this often may lead to a satisfactory and productive quality of life. A regular exercise regimen will often be beneficial in reducing these symptoms somewhat, as the muscular and skeletal system are not directly affected by this disease, and exercise such as regular walking keeps the body healthy. However, walking can be affected by the sudden immobility or freezing.

Many people with Parkinson's Disease, or PD, periodically experience a motor block episode, often called "freezing", in which the person is suddenly made immobile, with a feeling as if his or her feet are "glued" to the floor. This can happen suddenly while walking, and can lead to loss of balance and falls. The occurrence of freezing is controlled somewhat by the patient's medication, but will occur without warning in more advanced cases, or in less advanced cases where the medication wears off. Adjusting the PD medication will not always fully solve this problem. Freezing episodes are sometimes triggered by visual stimuli, such as a change in flooring patterns, or from observing an elevator door closing or opening. Freezing occurs rather frequently when the patient is navigating through narrow passageways or small spaces. Freezing episodes will usually resolve spontaneously, but this demands time and patience. Coping with this problem can be annoying and frustrating to the PD patient. Where this happens frequently, the patient is often afraid to go out or to engage in any sort of activity on foot.

Some compensating strategies that have been tries include visualization techniques, that is, imagining a line or object on the floor, and then stepping over the imaginary object. This strategy can be successful, but requires training and concentration. Other strategies include changing the visual focus to a distant point instead of looking directly below; counting a cadence or marching in place; or rocking from side to side to break the forward "freeze."

Many PD patients carry a cane or walking stick simply to assist in balance during walking. This can also be of help if balance or strength on the affected side is affecting gait stability. However, this should usually be a straight cane or stick, as tripod or quad canes are difficult for a PD patient to use correctly.

OBJECTS AND SUMMARY OF THE INVENTION

Accordingly, it is an object of this invention to provide a simple device that will assist a PD patient to overcome the sudden immobility or "freezing" as discussed above.

It is another object to provide a cane or stick that can be used as a visual stimulation to break the freezing and help the patient to initiate the first step. or can be used as a It is yet another object to provide a cane or stick that can be used by the PC patient as the necessary stimulation for walking, and may also be used as a walking cane to assist in balance.

It is a further object to provide a visual stimulation cane that is of straightforward design, is light weight, and does not have a great cost.

In accordance with an aspect of the present invention, a visual stimulation cane has a lightweight shaft having an upper end and a lower end. Favorably, there is a handle at the upper end, and a visual indicator at the lower end of the shaft. The visual indicator can be extended over the floor, ground, or other walking surface as a visible line or bar which the user can step over. Thus the visual stimulator helps the patient in overcoming a freezing episode. This visual indicator at the base of the cane can be extended, when needed, from a withdrawn position to its extended position. An actuator mechanism is situated at the lower end of the shaft permitting the user to move the visual indicator between its withdrawn and its extended positions. Preferably, the visual indicator is in the form of a thin semi-rigid strip or leg that can swing up to the withdrawn position along side the shaft of the cane, or can be swung down to a substantially horizontal position as a visual stimulus. In one preferred arrangement the cane has a spring-loaded piston or plunger that extends from the lower end of the shaft, and the leg is mounted on a pivot member that is rotated by the plunger. When downward pressure is applied on the handle, the leg comes down to its extended position and provides the necessary visual stimulus. The leg retracts back to the raised position when pressure is released. There can be a locking mechanism, i.e., a knob or other switch, to lock the visual indicator in the withdrawn or raised position, so that the cane can be used simply for balance. The shaft can be made as an upper and lower tube that telescope together and can be adjusted for the proper length.

In an alternative arrangement, a different visual indicator can be used. For example, the indicator may take the form of a coiled metal tape, like a steel measuring tape, that rotates and uncoils out to an extended position when the user presses down on the handle, and recoils back into the lower part of the cane when the downward pressure is relieved. In some circumstances, a laser or lamp could provide a line of light on the floor or walking surface as a visual stimulus.

The above and many other objects, features, and advantages of this invention will become apparent to persons skilled in the art from the ensuing description of a preferred embodiment, which is to be read in conjunction with the accompanying Drawing.

DETAILED DESCRIPTION OF THE PREFERRED EMBODIMENTS

Figure 1:
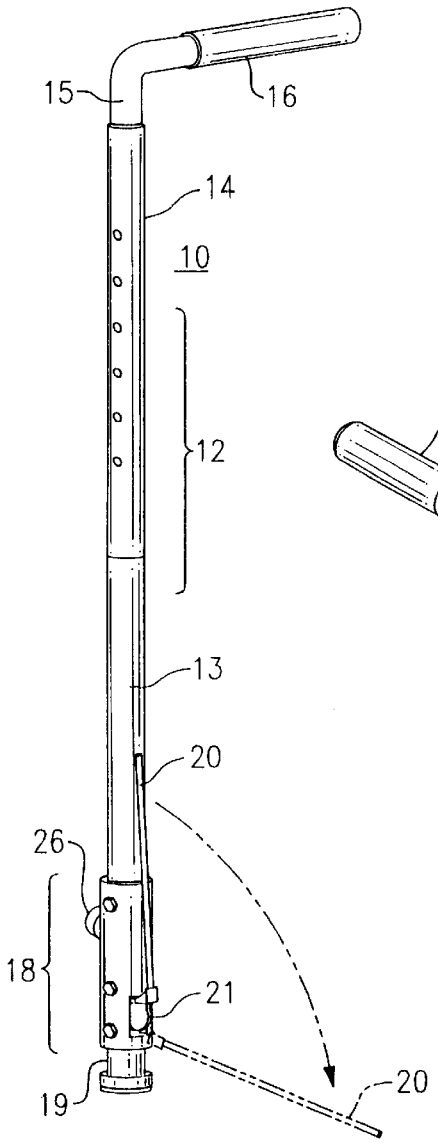
FIG. 1 is a perspective view of a visual stimulation cane according to one embodiment of the present invention.
Figure 2:
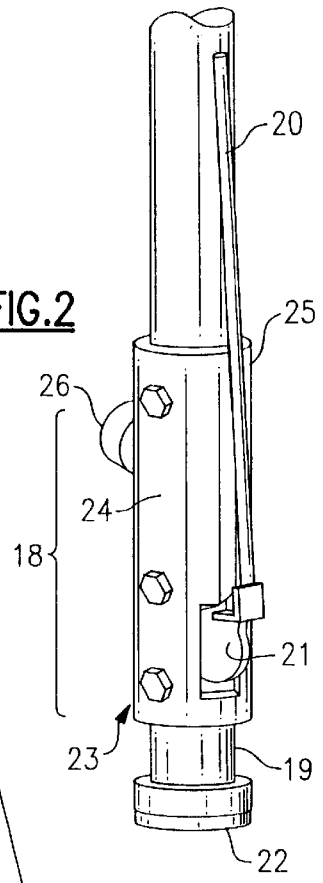
FIG. 2 is an enlargement of a lower portion of this embodiment.

With reference to the Drawing, and initially to FIGS. 1 and 2, a visual stimulation cane 10 is shown to include a tubular aluminum shaft 12 that is in two telescoping components, i.e., a lower or center tube 13 and an extendible upper tube 14. An L-shaped handle 16 is fitted into the upper end of the upper tube 14, and in this case has a grip 16 for comfort and security in gripping the cane. Of course, in other embodiments, there can be a J-shaped handle, T-shaped handle, a knob, or other handle configuration.

A visual stimulation assembly 18 is situated at the lower or distal end of the shaft 12. In this case there is a plunger 19 that has a limited vertical travel and an indicator leg 20 that swings between a raised or withdrawn position, here shown in full line, and a lowered or extended position, here shown in ghost line. A pivot member 21 in the assembly 18 rotates when the plunger 19 travels, and carries one end of the indicator leg 20. Here, the leg is an elongated flexible, thin plastic member, and is removably held a retainer on the pivot member, so that it can be replaced easily if broken. A supply of extra legs 20 can be stored within the cane, for example, in the handle 15. The leg 20 can be colored a bright color on its upper side (i.e., considered in the extended position), for better visibility. A rubber tip or pad 22 can be situated at the base of the plunger 19.

The assembly 18 has a housing 23, formed of a front housing half 24 and a rear housing half 25, which fits onto the lower end of the center tube 13. A lock/unlock knob 26 can be rotated ninety degrees in one direction to permit the plunger 19 to move and rotate the pivot member 21 and leg 20, and can be rotated ninety degrees in the other direction to block movement of the plunger 19 as well as the pivot member 21 and indicator leg 20. In other arrangements, other locking mechanisms can be employed. In some versions, the locking knob may be on the handle.

Figure 3:
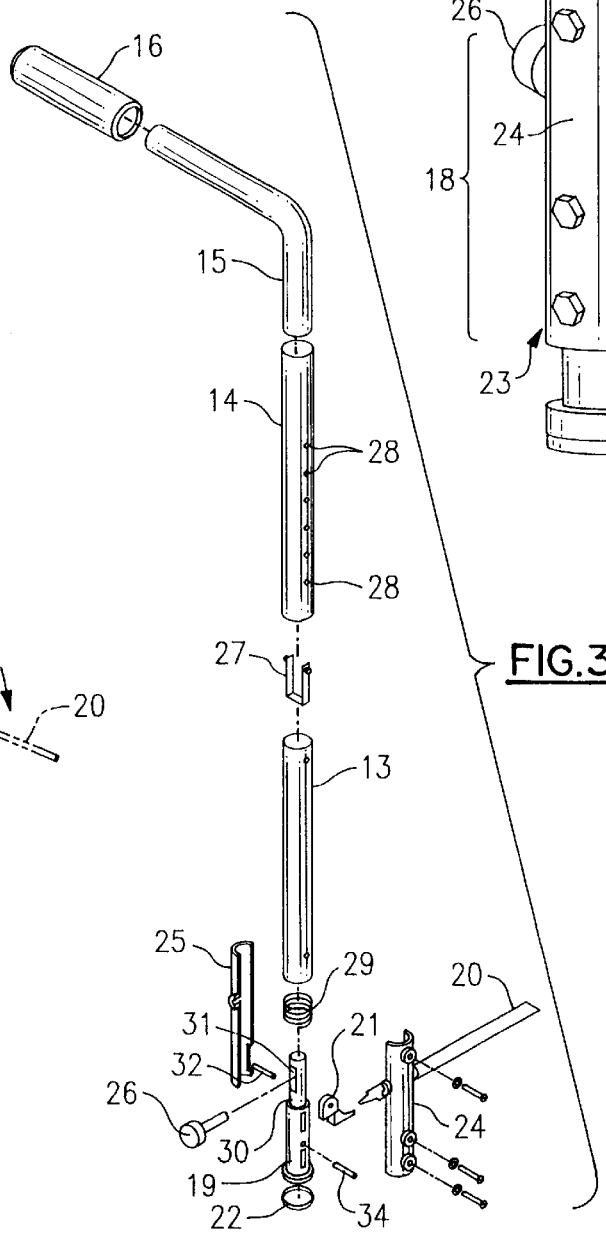
FIG. 3 is an exploded assembly view of this embodiment.
Figures 4, 5:
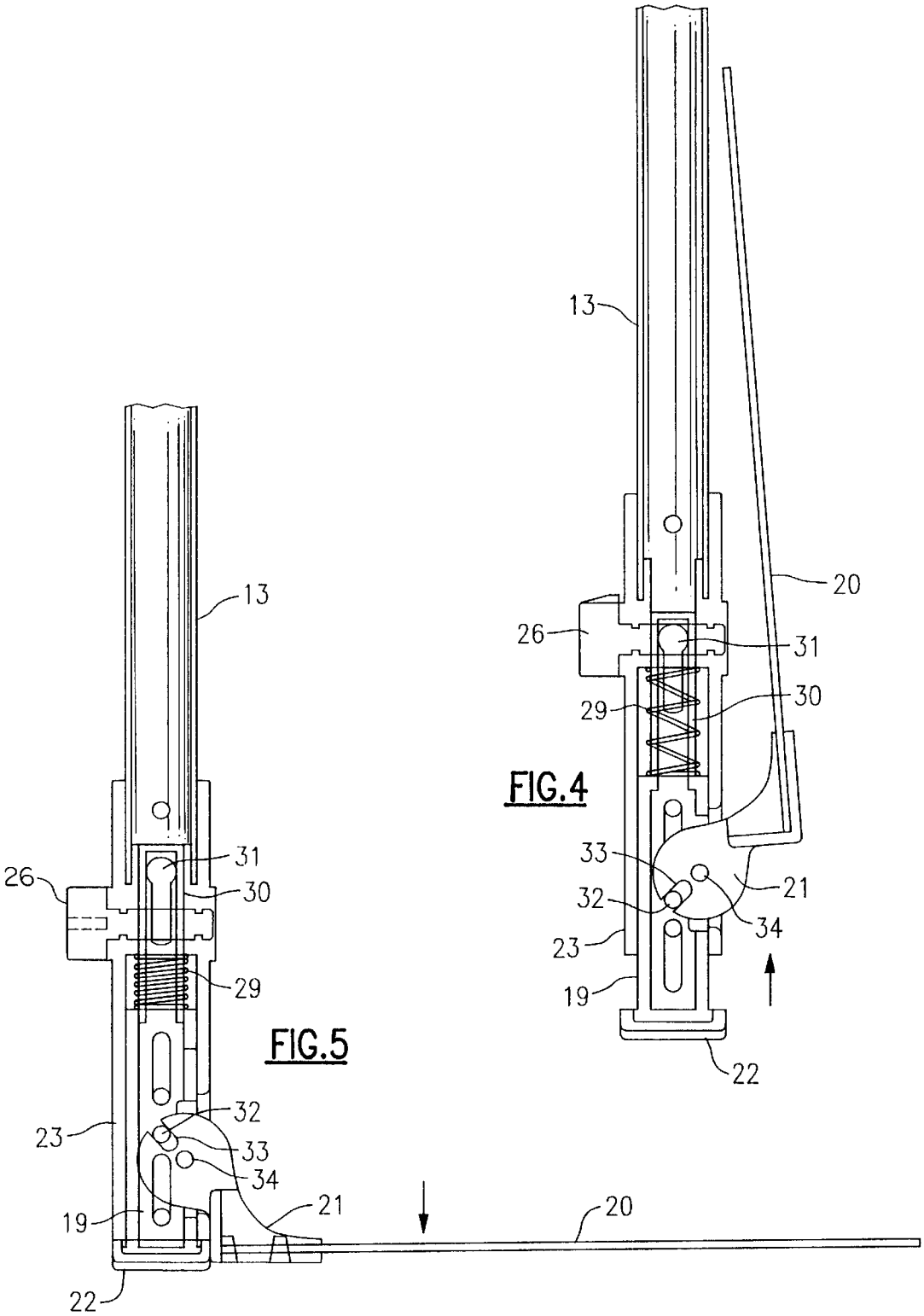
FIG. 4 is a cross sectional view showing details of this embodiment.
FIG. 5 is a cross sectional view showing the visual indicator leg in its lowered or extended position.

The visual stimulation cane 10, and in particular the assembly 18, is shown in greater detail in FIGS. 3 and 4. As shown in FIG. 3, a snap lock button 27 is fitted within the shaft 12 and engages with holes 28 in the upper tube 14. This permits the length of the cane 10 to be adjusted to the user's needs. In the visual stimulator assembly 18, a coil spring 29 fits over a reduction or neck 30 on the upper part of the plunger 19, and engages both a shoulder of the plunger 19 and an upper wall of the housing 23. There is a generally key-hole shaped knob clearance passage 31 in this neck 30 through which the shaft of the knob 26 passes. The shaft has an oblong cross section, so that it engages the upper round part of the passage 31 when turned one way, but permits the lower straight portion to pass when the knob is turned in the other direction.

As shown in FIG. 4, a guide pin 32 is mounted on the plunger 19 to engage a radial slot 33 in the indicator pivot member 21. The pivot member 21 is mounted by a pivot pin 34 to the indicator housing 23. When the knob 26 is turned to the unlock position, and the user applies a downward pressure on the cane 10, the pressure will move the plunger 19 upwards into the housing, and rotate the pivot member 21 and indicator 20 from the upward, or withdrawn position of FIG. 4 to the lowered or extended position of FIG. 5. These two positions involve a rotation of between about 90 and 100 degrees, and in this embodiment, about 97 degrees.

Also shown in FIGS. 3, 4 and 5, the front and rear housing halves 24, 25 are secured together by shoulder screws and lock washers, with the upper screw attaching to the center tube 13 and the lower two screws also guiding the travel of the vertical plunger 19. In other versions, other fastening means could be employed. In this embodiment, the handle 15 is a separate member attached to the upper tube 14, but in other versions, the handle could be formed by bending an upper portion of the tube 14.

The use of this cane 10 is rather straightforward.

For ordinary conditions, the knob 26 can be placed in the locked position, and the cane can be used as a normal walking cane or walking stick to help the user keep his or her balance. The visual stimulation cane can be adjusted for height. The position of the indicator 20 relative to the handle 15 may be rotated, so that the cane can be used on either the left hand side or the right hand side, whichever is preferred. That is, the cane 10 can have the indicator leg 20 extend either to the right or to the left. In many patients, PD affects one side more than the other, and the cane 10 may accommodate that. The rubber tip or bumper 22 prevents slipping when the cane is used as a walking assistance and balance device, and also prevents slipping when downward pressure is applied to extend the indicator leg 20.

Figure 6:
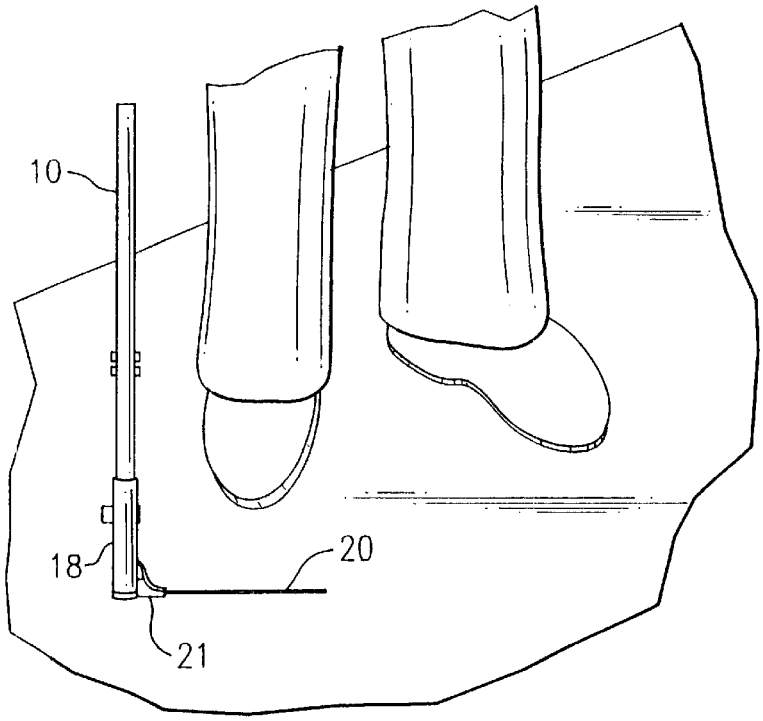
FIGS. 6 and 7 are perspective views demonstrating a Parkinson's Disease patient employing the cane of this embodiment to overcome a "freezing" episode.
Figure 7:
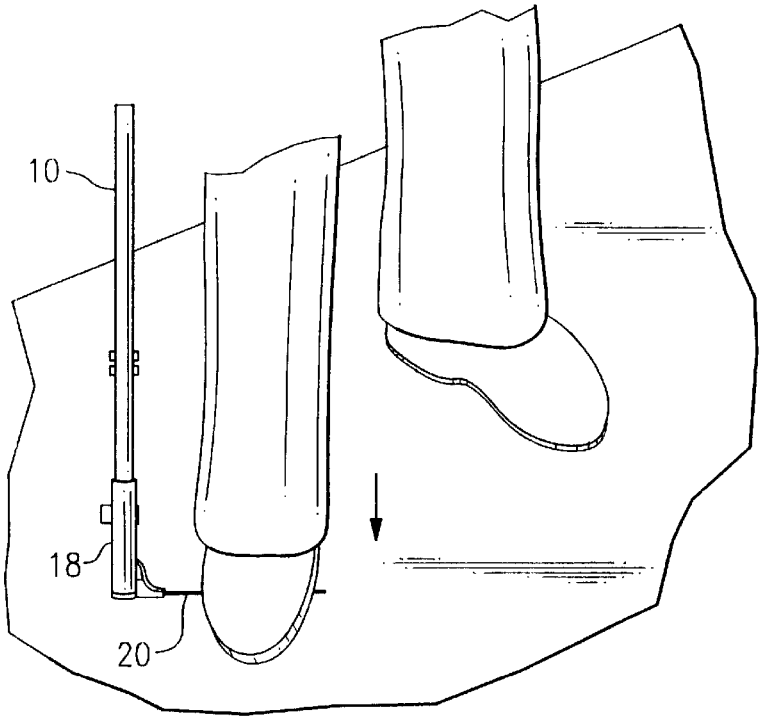

When the user begins to experience a freezing episode, and is suddenly immobilized due to this effect of Parkinson's Disease, the user only has to release the locking mechanism by rotating the knob 26. Then the user places the visual stimulation cane 10 a short distance in front and on the side of the dominant foot, as shown in FIG. 6. The user applies a small downward pressure, for example, simply by leaning forward slightly. This pressure rotates the indicator pivot 21, which moves the indicator downward to the extended position, which is now a short distance ahead of the user's foot. The indicator leg 20 creates a line on the floor or other walking surface, such as a footpath or lawn, and gives the user the visual stimulation necessary to initiate the first step. The user then steps over the extended indicator leg 20, as shown in FIG. 7. When the pressure on the handle 15 is released, the indicator leg 20 retracts. The user may repeat this process as many times as is necessary.

Use of this cane 10 permits the PD sufferer to enjoy much greater mobility by permitting him and her to deal easily with the possibility of sudden immobility. This reduces the fear of being unable to move, thereby encouraging and permitting the user to enjoy more normal work and recreation activities, and to lead a more enjoyable lifestyle. In some cases, this may permit the treating physician to reduce the dosage or frequency of PD medication.

While the invention has been described in detail with respect to one preferred embodiment, it should be recognized that there are many alternative embodiments that would become apparent to persons of skill in the art. Many modifications and variations are possible which would not depart from the scope and spirit of this invention, as defined in the appended claims.

We claim:

1. A visual stimulation cane, comprising a shaft which can be carried by a user and having an upper end and a lower end;

a flat, flexible elongated visual indicator bar disposed at the lower end of the shaft for selectively providing, along a walking surface, a visible line which the user can step over as a visual stimulation for overcoming a freezing episode, said visual indicator bar being movable between a withdrawn position and an extended position, wherein in the extended position the visible indicator bar lies straight and flat against the walking surface, so that the user can visualize a line on the walking surface and step over it; and an actuator disposed at the lower end of said shaft for permitting the user using one hand at the upper end of the shaft to selectively move said visual indicator between its withdrawn and its extended positions.

2. A visual stimulation cane according to claim 1 wherein said visual indicator bar includes a leg pivotally mounted at the lower end of the shaft, such that in its withdrawn position it is oriented alongside said shaft, and in its extended position it is oriented radially outward from the lower end of said shaft.

3. A visual stimulation cane according to claim 2 wherein said actuator includes a pivot member rotatable about a horizontal axis, and having means on said pivot member on which said leg is replaceably mounted.

4. A visual stimulation cane according to claim 3 wherein said pivot member is rotatable over substantially ninety to a hundred degrees to reach said withdrawn and extended positions.

5. A visual stimulation cane according to claim 3 wherein said actuator also includes a spring-loaded plunger extending from the lower end of said shaft for rotating said pivot member.

6. A visual stimulation cane according to claim 5 wherein said actuator also includes a lock/unlock switch permitting the user to selectively disable the actuator so that the cane can be used for aiding in walking without visual stimulation.

7. A visual stimulation cane according to claim 2 wherein leg is a flat, elongated semi-rigid plastic member.

8. A visual stimulation cane according to claim 1 wherein said actuator includes a spring-loaded plunger at the lower end of said shaft, and a rotatable pivot member mounted in said shaft and rotated by said plunger in one direction to extend said visual indicator and in an opposite direction to withdraw said visual indicator.

9. A visual stimulation cane according to claim 1 wherein said shaft includes first and second tube members that telescope together and can be adjusted to a desired length.

10. A visual stimulation cane according to claim 1 including a handle disposed at the upper end of said shaft, and which can be selectively oriented relative to the indicator so that the indicator extends to the right or left of the cane, as desired by the user.

11. A visual stimulation cane according to claim 1 wherein the withdrawn position of said indicator is a raised position and the extended position thereof is a lowered position.

12. A visual stimulation cane, comprising a shaft which can be carried by a user and having an upper end and a lower tip end;

a handle situated at the upper end of the shaft;

said lower tip end being adapted to contact a walking surface;

a visual indicator bar disposed at the lower end of the shaft for selectively providing, along said walking surface, a visible line which the user can step over as a visual stimulation for overcoming a freezing episode, said visual indicator bar being movable between a withdrawn position and an extended position wherein the visible indicator bar is a flat, elongated member and lies flat against the walking surface when in the extended position, so that the user can visualize a line on the walking surface and step over it; and an actuator disposed on the tip end of said cane and responsive to pressure applied by the user to said handle for selectively moving said visual indicator bar between its withdrawn and its extended positions.

13. A visual stimulation cane according to claim 12 wherein said visual indicator bar includes a leg pivotally mounted at the lower end of the shaft, such that in its withdrawn position it is oriented alongside said shaft, and in its extended position it is oriented radially outward from the tip end of said shaft.

14. A visual stimulation cane according to claim 13 wherein said actuator includes a pivot member rotatable about a horizontal axis, and having means on said pivot member on which said leg is replaceably mounted.

15. A visual stimulation cane according to claim 13 wherein in the extended position of the visual indicator bar, said leg is deployed substantially against said walking surface.

16. A visual stimulation cane comprising a shaft which can be carried by a user and having a lower end and a handle at an upper end thereof; and a spring-loaded plunger-driven visual actuator mechanism disposed at the lower end of said shaft, including:

an elongated visual indicator member that provides along a walking surface a visible line which the user can step over as a visual stimulation to overcome a freezing episode, said visible indicator being selectively movable between a withdrawn position and an extended position;

a spring-loaded plunger actuator mechanism disposed at the lower end of said shaft and including a spring-loaded plunger extending from said lower end of said shaft and having a lower tip for contacting said walking surface, said plunger being movable relative to said shaft in response to pressure applied by the user onto said handle, and means for swinging said visual indicator member between its withdrawn position and its extended position in response to motion of said plunger.

17. A visual stimulation cane according to claim 16, wherein said means for swinging includes a pivot member having a retainer portion thereon for releasably and reattachably holding said visual indicator member such that the visual indicator member can be reattached or replaced by the user.

18. A visual stimulation cane according to claim 16, wherein said plunger actuator mechanism includes a housing mounted onto the lower end of said shaft; a plunger in said housing and extending downward out of said housing and capable of at least limited vertical motion in respect to said shaft and said housing; a spring biasing said plunger downward relative to said housing and said shaft; and a pivot member rotationally engaged with said plunger for swinging the visual indicator member between its withdrawn and extended positions.

19. A visual stimulation cane according to claim 16, further including locking means for selectively disabling motion of said plunger.

20. A visual stimulation cane according to claim 18, wherein said pivot member has a range or rotation of between 90 and 100 degrees.

* * * * *